US006906025B2

(12) United States Patent
Levinson

(10) Patent No.: US 6,906,025 B2
(45) Date of Patent: Jun. 14, 2005

(54) ARTICLES AND METHODS FOR TREATING FABRICS BASED ON ACYLOXYALKYL QUATERNARY AMMONIUM COMPOSITIONS

(75) Inventor: Matthew Levinson, Lincolnwood, IL (US)

(73) Assignee: Stepan Company, Northfield, IL (US)

( * ) Notice: Subject to any disclaimer, the term of this patent is extended or adjusted under 35 U.S.C. 154(b) by 0 days.

(21) Appl. No.: 10/680,541

(22) Filed: Oct. 7, 2003

(65) Prior Publication Data

US 2004/0076829 A1 Apr. 22, 2004

Related U.S. Application Data

(63) Continuation of application No. 10/238,257, filed on Sep. 10, 2002, now abandoned, which is a continuation of application No. 09/853,503, filed on May 11, 2001, now abandoned, which is a continuation of application No. 09/397,237, filed on Sep. 16, 1999, now abandoned, which is a continuation of application No. 09/129,373, filed on Aug. 5, 1998, now abandoned, which is a continuation of application No. 08/583,674, filed on Jan. 5, 1996, now abandoned.

(51) Int. Cl.[7] ..... C11D 1/835
(52) U.S. Cl. ..... 510/520
(58) Field of Search ..... 510/519, 520

(56) References Cited

U.S. PATENT DOCUMENTS

| | | | | |
|---|---|---|---|---|
| 3,435,537 | A | | 4/1969 | Rumsey et al. |
| 3,634,947 | A | | 1/1972 | Furgal et al. |
| 3,676,199 | A | | 7/1972 | Hewitt et al. |
| 3,686,026 | A | | 8/1972 | Morton et al. |
| 3,701,202 | A | | 10/1972 | Compa et al. |
| 3,736,668 | A | | 6/1973 | Dillarstone et al. |
| 3,944,694 | A | | 3/1976 | McQueary et al. |
| 4,022,938 | A | | 5/1977 | Zaki et al. |
| 4,096,071 | A | | 6/1978 | Murphy et al. |
| 4,103,047 | A | | 7/1978 | Zaki et al. |
| 4,159,356 | A | | 6/1979 | Jablonski et al. |
| 4,749,596 | A | | 6/1988 | Evans et al. |
| 4,764,289 | A | | 8/1988 | Trinh et al. |
| 4,767,548 | A | | 8/1988 | Kasprzak et al. |
| 4,786,422 | A | | 11/1988 | Kern et al. |
| 4,824,582 | A | | 4/1989 | Nayar et al. |
| 4,882,076 | A | | 11/1989 | Kern et al. |
| 4,906,410 | A | | 3/1990 | Lacke et al. |
| 5,080,810 | A | | 1/1992 | Smith et al. |
| 5,102,564 | A | | 4/1992 | Gardlik et al. |
| 5,128,053 | A | | 7/1992 | Gummo et al. |
| 5,234,610 | A | | 8/1993 | Gardlik et al. |
| 5,305,881 | A | | 4/1994 | Caldwell et al. |
| 5,503,756 | A | * | 4/1996 | Corona et al. ..... 510/519 |

FOREIGN PATENT DOCUMENTS

| | | | |
|---|---|---|---|
| DE | 3818013 | A1 * | 11/1989 |
| DE | 4224067 | A | 1/1994 |
| DE | 34 26 197 | | 1/1996 |
| EP | 0345495 | A | 12/1989 |
| EP | 0431652 | A | 6/1991 |
| EP | 580527 | A | 1/1994 |
| WO | WO 91/12364 | | 8/1991 |
| WO | WO 95/04802 | | 2/1995 |

* cited by examiner

*Primary Examiner*—John R. Hardee
(74) *Attorney, Agent, or Firm*—McAndrews, Held & Malloy Ltd.

(57) ABSTRACT

Disclosed are automatic dryer added fabric conditioning articles and methods utilizing fabric conditioning compositions comprising from about 20 percent to about 80 percent by weight of a mixture of quaternary ammonium compounds, and between about 80 percent to about 20 percent by weight of a mixture of glycerin and glyceryl esters, wherein the fabric conditioning compositions possess a melting point of about 30° C. to about 65° C. The conditioning compositions of the present invention are preferably employed in combination with a dispensing means adapted for use in an automatic clothes dryer. The fabric conditioning compositions may be coated onto substrates, and the fabric conditioning articles thereby obtained used to impart softness and anti-static properties to fabric. The method portion of the invention involves the commingling of damp fabrics with the fabric conditioning compositions in an automatic clothes dryer to impart softness and anti-static properties to the fabric. The compositions of this invention, when coated onto substrates are mechanically and thermally stable and thus are not dislodged or prematurely released when substrate is flexed, twisted and/or stored at room temperature.

11 Claims, No Drawings

ARTICLES AND METHODS FOR TREATING FABRICS BASED ON ACYLOXYALKYL QUATERNARY AMMONIUM COMPOSITIONS

RELATED APPLICATIONS

Continuation of application Ser. No. 10/238,257, filed on Sep. 10, 2002, now abandoned, which is a continuation of application Ser. No. 09/853,503, filed on May 11, 2001, now abandoned, which is a continuation of application Ser. No. 09/397,237, filed on Sep. 16, 1999, now abandoned, which is a continuation of application Ser. No. 09/129,373, filed on Aug. 5, 1998, now abandoned, which is a continuation of application Ser. No. 08/583,674, filed on Jan. 5, 1996, now abandoned.

BACKGROUND OF THE INVENTION

1. Field of the Invention

The present invention relates to improved dryer added fabric conditioning articles and methods for providing softening and static control properties to fabric in an automatic clothes dryer. The invention further relates to improved fabric conditioning compositions and the process of making said fabric conditioning compositions. More particularly, these fabric conditioning compositions comprise compounds having quaternary ammonium functionality(s) and ester linkages therein. The fabric conditioning compositions further contain mixtures of glycerin, mono-, di- and triglycerides. The fabric conditioning compositions are preferably releasably attached to a flexible substrate, e.g., a dryer sheet, but may also be in liquid form, particulate form, or compounded with other materials in solid form, e.g., tablets, pellets agglomerates, etc.

2. Description of the Related Art

The use of fabric conditioning compositions to treat fabric during the laundering process to soften the fabric, give the fabric greater bulk, make the fabric easier to iron, decrease the fabric drying time and reduce the static charge on the fabric is well known in the art. Fabric softness or conditioning is usually understood to be that quality of the treated fabric whereby its handle or texture is smooth, pliable and fluffy to the touch. Fabric conditioning also connotes the absence of static "cling" or static electricity in the fabrics, and in general, fabric conditioning compositions or fabric softeners provide both softening and antistatic benefits when applied to fabric.

Fabric conditioning compositions may be utilized in the washing cycle and/or the drying cycle of the laundering process. Fabric conditioning compositions, which are utilized during the drying cycle in automatic tumble dryers, are typically attached to a flexible substrate, e.g., a dryer sheet. The fabric conditioning composition is coated onto the dryer sheet and the resulting fabric softener sheet is commingled with moist fabrics in an automatic laundry dryer. The heating and tumbling action of the dryer aids in the transfer of the fabric conditioning composition from the dryer sheet to the fabric surface. Several known advantages of dryer-added fabric conditioning compositions, over wash cycle added fabric conditioning compositions, include a more convenient time of addition in the laundering process, avoidance of fabric conditioning composition/washing detergent composition incompatibility and an optimized, pre-measured amount of the fabric conditioning composition.

Fabric conditioning compositions applied during the drying cycle in automatic clothes dryers have a very different focus as compared to rinse added fabric conditioning compositions. Unfortunately, by statistical testing it is difficult, if not impossible, to quantitate differences in the softening performance delivered by different brands of commercially available fabric softener sheets because of the non-uniform mass transfer of active ingredients from the flexible substrate to the fabric surface. The softening performance delivered by commercial fabric softener sheets is often a subjective quality which varies greatly with different consumers.

Fabric softener sheets function primarily as a means to reduce static and as a carrier of perfume and other optional ingredients. In order to function properly, the fabric conditioning compositions present on the sheets must have a proper melt range, a suitable substrate release profile, and uniform damp fabric spreadability without spotting or staining the fabric. Some fabric softening compositions adhere to the dryer sheet too strongly, causing incomplete transfer of the softener to the fabric, less than complete transfer requires the use of excess softening material on the dryer sheet to assure sufficient static reduction, perfume delivery and conditioning effects. The use of high levels of fabric conditioning composition on the dryer sheets is inefficient and may in turn lead to deposition of concentrated patches of fabric conditioning composition on the fabric causing an undesirable stain.

Typically, fabric conditioning compositions for use in dryer sheet applications are heated from about 160° F. to about 180° F. and transferred onto a fabric substrate or web via a high speed coating or spraying process. After the web is contacted with the molten active components, it is cooled to a temperature where the softening coating is no longer tacky. The web is then perforated, spooled, cut and packaged. The melting point and viscosity characteristics of the fabric conditioning composition are critical factors which affect dryer sheet production rate and consumer acceptance; high viscosity materials can put a drag on the web and cause it to break, forcing slower web speeds. From a consumer point-of-view, the finished product must be tack-free and must not bleed when packaged within a box, even during extended storage at elevated warehouse or trucking temperatures.

Thus, a continuing need is recognized in the art to increase the evenness and the completeness of transfer of the fabric conditioning composition from the dryer sheet to the fabric. Further needs are also recognized in the art for fabric conditioning compositions with proper melt ranges, viscosities, release characteristics from the substrate, and spreading properties on the damp fabric so that the fabric conditioning compositions distribute relatively uniformly, without spotting or staining said fabric.

Various approaches have been taken in the prior art to overcome the aforementioned limitations and problems of fabric softening compositions coated on dryer sheets. In general, the term "esterquat" is defined as a compound which posses one or more quaternary nitrogens and one or more ester functionalities.

Fatty alkyl cationic antistatic softening compositions for use in automatic dryers have been the subject of many patents. For example, see U.S. Pat. No. 3,634,947, Furgal, issued Jan. 18, 1972, and U.S. Pat. No. 3,676,199, Hewitt et al., issued Jul. 11, 1972.

Three major fabric softener compositions are currently used in commercial dryer sheet applications. The first fabric softener which is employed on a commercial scale in laundry detergents, softening rinses and dryer sheets is N-dihydrogenatedtallow-N,N-dimethylammonium sulfate (DHTDMAS). The use of this material in a dryer sheet application is the subject of U.S. Pat. No. 3,944,694, McQueary, issued Mar. 16, 1976. The second composition involves the use of dihydrotallow dimethylammonium methosulfate in combination with a nonionic component such as polyethylene glycol esters or stearic acid ethoxylates (2–4 moles), in a 70:30 ratio. The use of this material in a dryer sheet application is the subject of U.S. Pat. No. 4,159,356, Jablonski, issued Jun. 26, 1979. The third composition involves the use of hard tallow imidazolinium quaternary compounds, in combination with a nonionic component such as polyethylene glycol esters or stearic acid ethoxylates (2–4 moles), in varying ratios. This material is sold under the name Accosoft® PX57-S or 870, manufactured by Stepan Company, Northfield, Ill.

Other components have been patented for use in dryer sheets, such as diamidoamine ethoxylates based on hard tallow, in U.S. Pat. No. 4,906,410, Lacke et al., issued Mar. 6, 1990; sorbitan esters with hard fatty acids, in U.S. Pat. No. 4,096,071, Murphy, issued Jun. 20, 1978; salts formed from mono and di-alkyl amines and anionic surfactants, in U.S. Pat. No. 4,824,582, Nayar, issued Apr. 25, 1989, U.S. Pat. No. 4,786,422, Kern, issued Nov. 22, 1988 and U.S. Pat. No. 4,882,076, Kern, issued Nov. 21, 1989; DHTDMAS with polydiorganosilanes, in U.S. Pat. No. 4,767,548, Kasprzak, et al., issued Aug. 30, 1988; N-alkyl-N,N-dimethyl amine oxides in combination with DHTDMAS, in U.S. Pat. No. 5,080,810, Smith, et al., issued Jan. 14, 1992; and ethoxylated piperazine ester quats, in U.S. Pat. No. 5,128,053, Gummo, et al., issued Jul. 7, 1992. The use of minor amounts of fatty esters of sorbitan polyols in conventional fatty alkyl substituted quaternary ammonium salt softening compositions has also been shown to provide improved release of the softening compositions from the dryer sheet.

In the last 5 years, soil release agents have been incorporated into fabric softening composition which are deposited on dryer sheets to create a multi-functional, fabric enhancing product, as described in U.S. Pat. No. 4,749, 596, Evans, et al., issued Jun. 7, 1988 and U.S. Pat. No. 4,764, 289, Trinh, issued Aug. 16, 1988. The latest technology focus has been the development of fragrance persistent formulations using cyclodextrins to trap volatile components, as disclosed in U.S. Pat. No. 5,102,564, Gardlik, et al., issued Apr. 7, 1992 and U.S. Pat. No. 5,234,610, Gradlik, et al., issued Aug. 10, 1993.

Other related developments revolve around packaging, such as the folded single napkin dryer sheet product disclosed in U.S. Pat. No. 5,305,881, Caldwell, et al., issued Apr. 26, 1994.

Recent esterquat developments rely on a low melting esterquat combined with a DHTDMAS type quaternary ammonium compound in a ratio of about 1:10 to about 2:1. This material is further combined with an acid or ester, preferably citric acid.

The usual raw materials for the production of esterquats have been methyl esters and/or fatty acids. These fatty sources arm condensed with triethanolamine (TEA), methyldiethanolamine (MDEA), or alkoxylated/propoxylated derivatives of DEA and MDEA, to produce an intermediate esteramine product Typically when TEA is utilized, the ratio of fatty acid or methyl ester to TEA is adjusted to favor the formation of a di-ester condensation product which is formed along with the mono- and trimesters in a wt. % ratio approximating 20/60/20 mono:di:tri The mixed intermediate esteramine product is subsequently subjected to an alkylation reaction with dimethyl sulfate (DMS) to form a mixture of esterquats. A commercial example of these types is Stepantex® VA-90 (Stepan Company, Northfield Ill.).

Typically, the esterquat products of the alkylation reaction described above must have solvent added to them in order to keep the viscosity of the products in a manageable range which is typical for commercial rinse-added softener bases. Thus, nearly all esterquat products for rinse added softener applications contain at least 10% of an alcohol whose primary purpose is to lower the pour point and viscosity, and facilitate formulation. Alcohols such as isopropanol, propylene glycol, and dipropylene glycol have been used at 10–20 weight % based on the total weight of the composition. For virtually all dryer sheet manufacturers, this product is unsuitable due to the high level of VOC's (volatile organic compounds) which would be released during the heating and coating processes, and the attendant flammability issues.

A patent application, EP 580527 A1, discloses cationic surfactant compositions comprising, in quaternary ammonium salt form, the condensation product of a triglyceride and a tertiary amine, namely TEA (triethanolamine). The resulting compositions are useful as fabric softeners, hair conditioners, antistatic agents, lubricants, etc. This technology involves the reaction of whole triglycerides, optionally along with fatty acids, with TEA to generate interesterification products. The ratio of triglyceride to fatty acid to TEA allows control of the product mixture statistical distribution so that the di-ester of TEA predominates along with the mono-ester of glycerin. These are true statistical distributions, so that free glycerin, and mono-, di- and tri-glycerides are all formed, as are the mono- di- and tri-esters of TEA. The triglycerides and fatty acids may be animal or vegetable derived, and may be either saturated or unsaturated, or mixtures thereof.

These products are then quaternized with DMS in the presence of a low molecular weight alcoholic solvent, and may be formulated into concentrated rinse-addable products which contain esterquat in about 1–25% weight percent, based on the total weight of the formulation. The mono-, di- and tri-glycerides are known to be complementary active softening ingredients.

It has now been surprisingly discovered that new compositions based on homogeneous blends of mixed acyloxyalkyl quaternary ammonium compounds, in the presence of glycerin, and mono-, di- and triglycerides am fabric conditioning compositions that provide static control and softness to fabric in an automatic clothes dryer.

The invention therefore provides static control and softness to fabric treated with mixed acyloxyalkyl quaternary ammonium compounds, glycerin, and mono-, di-, and triglycerides. The invention further alleviates many of the aforementioned difficulties and limitations of fabric conditioning compositions currently used in current dryer sheet applications. The compositions of the present invention are substantially free of low-molecular weight glycol and alcoholic solvents and are particularly useful as fabric softening compositions in automatic dryer sheet applications.

This and other objects are obtained herein, as will become apparent from the following disclosure. The terms alkyl and alkenyl are defined as hydrocarbon radicals which are saturated and unsaturated, respectively.

It is therefore an object of the present invention to provide static control and softness to fabric treated with mixed acyloxyalkyl quaternary ammonium compounds, glycerin, mono-, di- and triglycerides. It is further and object of the present invention to alleviate many of the aforementioned difficulties and limitations of fabric conditioning compositions currently used in current dryer sheet applications. The compositions of the present invention are substantially free of low-molecular weight glycol and alcoholic solvents and are particularly useful as fabric softening compositions in automatic dryer sheet applications.

This and other objects are obtained herein, as will become apparent from the following disclosure. The terms alkyl and alkenyl are may defined as hydrocarbon radicals which are saturated and unsaturated, respectively.

SUMMARY OF THE INVENTION

The present invention relates to an article of manufacture adapted for use to provide fabric care benefits in an automatic laundry dryer comprising:

(a) a fabric conditioning composition comprising a mixture of about 20 percent to about 80 percent of acyloxyalkyl quaternary ammonium compound;

(b) about 80 percent to 20 percent of a mixture of glycerin, mono-, di- and triglycerides.

The most preferred fabric conditioning compositions are derived from mixtures of hard coconut oil and hard tallow.

The invention encompasses a method for imparting fabric care benefits in an automatic laundry dryer comprising tumbling the fabric in a clothes dryer with an effective amount of the fabric conditioning composition.

DETAILED DESCRIPTION OF THE INVENTION

The present invention relates to an article of manufacture adapted for use to provide fabric care benefits in an automatic laundry dryer comprising:

(a) a fabric conditioning composition comprising a mixture of about 20 percent to about 80 percent of an acyloxyalkyl quaternary ammonium compound and about 80 percent to about 20 percent of a mixture of glycerin and glyceryl esters;

wherein the fabric conditioning composition is a solid or semi-solid at room temperature and has a melting point of about 30° C. to about 65° C.; wherein the acyloxyalkyl quaternary ammonium compound has the following general formula:

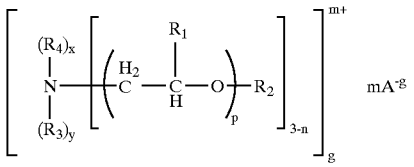

wherein each $R_1$ is independently a hydrogen atom or a branched or linear alkyl or alkenyl group from about 1–6 carbon atoms;

each $R_2$ is independently a hydrogen atom or an alkylcarbonyl group containing from about 11 carbon atoms to about 23 carbon atoms, with at least one $R_2$ group being an alkylcarbonyl group;

each $R_3$ is independently a branched or linear alkyl or alkenyl group from about 1–4 carbon atoms which is substituted or un-substituted with 1–3 hydroxyl groups, or is a group of the formula

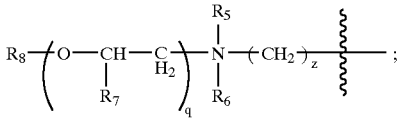

each $R_4$ is independently a branched or linear alkyl or alkenyl group from about 1–4 carbon atoms, which is substituted or un-substituted with 1–3 hydroxyl groups;

$R_5$ is a branched or linear alkyl or alkenyl group from about 8–23 carbon atoms;

$R_6$ is a branched or linear alkyl or alkenyl group from about 1–4 carbon atoms which is substituted or un-substituted with 1–3 hydroxyl groups;

each $R_7$ group is independently a hydrogen atom or a branched or a linear alkyl or alkenyl group from about 1–6 carbon atoms;

$R_8$ is a hydrogen atom or an alkylcarbonyl group containing from about 11 carbon atoms to about 23 carbon atoms; q=1–100; z=2 or 3; p=1–100; n=1 or 0; x and y are independently 0 or 1 with (x+y)+(3−n)=4; m=1 or 2; g=1, 2 or 3 and A is a monovalent anionic residue of an alkylating agent, or a monovalent or polyvalent anionic residue of a Bronsted acid; and wherein $R_2$ is derived from a mixture of hydrogenated tallow and hydrogenated coconut oil; wherein the ratio of hydrogenated tallow to hydrogenated coconut oil is from about 1:9 to about 8.5:1.5; wherein $R_2$ is derived from hydrogenated tallow; and wherein the glyceryl esters comprise monoglycerides, diglycerides and triglycerides;

wherein the monoglyceride has the following general formula:

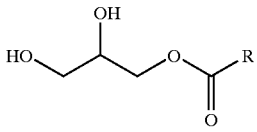

wherein R is a branched or linear alkyl or alkenyl group form about 11–23 carbon atoms;

wherein the monoglyceride has the following general formula:

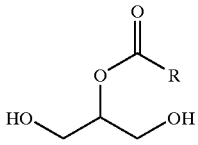

wherein R is a branched or linear alkyl or alkenyl group from about 11–23 carbon atoms;

wherein the diglyceride has the following general formula:

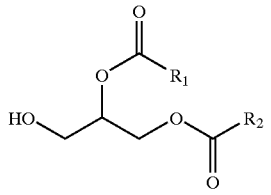

wherein $R_1$ and $R_2$ are independent abranched or linear alkyl or alkenyl groups from about 11–23 carbon atoms; wherein the diglyceride has the following general formula:

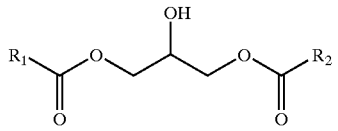

wherein $R_1$ and $R_2$ are independent branched or linear alkyl or alkenyl groups from about 11–23 carbon atoms; wherein the triglyceride has the following general formula:

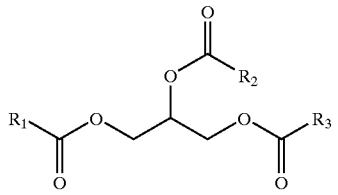

wherein $R_1$, $R_2$ and $R_3$ are independent branched or linear alkyl or alkenyl groups form about 11–23 carbon atoms; and wherein the alkylating agent is selected from a group comprising dimethyl sulfate, diethyl sulfate, dimethyl carbonate, trimethyl phosphate, methyl chloride, methyl bromide, methyl iodide, benzyl chloride and benzyl bromide;

(b) a dispensing means which provides for release of an effective amount of the fabric conditioning composition to fabric in an automatic clothes dryer;

wherein the dispensing means comprises a flexible substrate in a form of a sheet having the fabric conditioning composition releasably affixed thereto to provide a weight ratio of fabric conditioning composition to flexible substrate of about 10:1 to about 0.1:1; wherein the dispensing means comprises a sponge material releasably enclosing the fabric conditioning composition; wherein the weight ratio of fabric conditioning composition to sponge material of about 10:1 to about 0.1:1.

The invention further relates to a method for imparting softening and static reduction effects to fabric in an automatic laundry dryer comprising commingling articles of damp fabric by tumbling the damp fabric under heat in an automatic clothes dryer with an effective amount of the fabric conditioning composition, the fabric conditioning composition being flowable at dryer operating temperature, the fabric conditioning composition comprising a mixture of about 20 percent to about 80 percent of an acyloxyalkyl quaternary ammonium compound and about 80 percent to 20 percent of a mixture of glycerin and glyceryl esters.

The present invention is a substantial, unexpected improvement over the current triethanolamine ester-quaternary ammonium composition art, in that no auxiliary cationic compounds need be added to the softening compositions, nor must a separate acid or ester be prepared and added to the final softening compositions. The ester-quaternary ammonium compositions described herein possess acceptable melting point profiles for use in automatic clothes dryer sheet applications.

The fabric conditioning compositions are generally prepared without the use of glycol or alcohol solvents. Approximately 30 weight percent of the present compositions is nonionic components, which consists essentially of mono-, di-, triglycerides and glycerin. Theses nonionic components are generated in-situ and function to lower the handling temperature, reduce the viscosity, and affect the melting point range of the esteramine and its respective quaternary ammonium product.

The general method for preparing compositions of the present invention involves reacting a tertiary amine, typically triethanolamine, with whole triglycerides, optionally in the presence of fatty acids, at a temperature above the melting point of the tertiary amine/whole triglyceride mixture and below the degradation temperature of the tertiary amine/whole triglyceride mixture such that esterification and/or interesterification reactions occur. The reaction is run for a length of time sufficient to allow some portion of the triglyceride acyl moieties (or carboxylic acid groups) to esterify, interesterify or otherwise covalently bond with the hydroxyl groups or amine groups which are pendant off the tertiary amine. The esterification product is reacted with a Bronsted acid to generate the tertiary amine salt, or with an alkylating agent of sufficient reactivity to convert the tertiary amine residue into a quaternary ammonium residue.

The above described method for preparing the fabric conditioning compositions of this invention may allow for customization of the final product melting point profile by adjusting the following reaction parameters:

(a) varying the triglyceride to triethanolamine ratio so that triesters, or monoesters, are favored; and/or (b) incorporation of small amounts of fatty acid in combination with the triglyceride to effectively change the amount and ratio of monoglycerides to diglycerides formed; and/or (c) incorporating short chain triglycerides at varying percentages, while maintaining the same molar ratio of triglyceride to triethanolamine; and/or (d) incorporating some unsaturated triglycerides along with the saturated triglycerides.

Overall, the compositions of the present invention provide various advantages over conventional compositions. The raw materials used for the manufacture of the fatty alkyl cationic antistatic softening compounds of the present invention, namely whole triglycerides, are significantly more commercially cost effective, as compared to the use of fatty acids which are raw materials currently used to prepare conventional fatty alkyl cationic antistatic softening compounds. Other benefits of the present invention include the use of a less energy and less time intensive manufacturing process. i.e., the non-ionic components which modify the melt point and viscosity of the ester amine are generated in situ. The current invention also offers a simplified method of processing (fewer manufacturing steps, no blending steps), as compared to conventional manufacturing processes for fatty alkyl cationic antistatic softening compounds.

Further, the modification of the melting point and viscosity of the compositions of the present invention may be accomplished by adjusting the ratio of the reactants, the degree of unsaturation of the reactants, and/or the acyl chain distribution of the reactants. The biodegradability of the present compositions is comparable to other esterquats and has been found to be substantially better than DHTDMAS or imidazolinium based compositions.

Detailed Method of Preparation

The process for preparing the above said mixtures of acyloxy alkyl quaternary ammonium compounds and glycerin/glyceryl esters from a tertiary amine selected from the group consisting of tertiary ammonium compounds containing at least 1–3 hydroxy alkyl pendant groups comprises reacting said tertiary amine with whole triglycerides selected from the group consisting of $C_3$–$C_21$ alkyl(or alkenyl)acyloxy esters of glycerin (branched or linear), and optionally with $C_12$–$C_23$ alkyl(or alkenyl) substituted carboxylic acids (branched or linear):

(a) at a temperature above the melting point of the reaction medium and below the degradation temperature of the tertiary amine, and at a temperature sufficient to promulgate esterification and/orinteresterification reactions;

(b) for a length of time sufficient to allow some portion of the triglyceride acyl moieties or carboxylic acid groups to esterify, interesterify or otherwise covalently bond with the hydroxyl groups or amine groups which are pendant on said tertiary amine;

wherein the reaction temperature used to promulgate esterification and/or interesterification is about 30° C. to about 180° C. for a time of about 0.5 hours to about 48 hours.

Further, the above mixture is reacted with a Bronsted acid to generate the tertiary amine salt, or with an alkylating agent of sufficient reactivity to convert the tertiary amine residue into a quaternary ammonium residue, examples of which include but are not specifically limited to: dimethyl sulfate, diethyl sulfate, dimethyl carbonate, trimethyl phosphate, methyl chloride, methyl bromide, methyl iodide, benzyl chloride, and benzyl bromide:

(a) at a temperature above the melting point of the reaction medium and below the degradation temperature of the desired quaternary ammonium cation;

(b) for a length of time sufficient to convert at least a portion of the tertiary amine to the desired tertiary amine salt, or quaternary ammonium cation;

wherein the reaction temperature used to effect tertiary amine salt formation and/or quaternization is about 30° C. to about 180° C. for a time of about 0.5 hours to about 48 hours.

Optional Ingredients

Although not essential to the present invention, optional ingredients may be added to the compositions, wherein the optional ingredients provide a preservative affect and color lightening affect to the fabric softening compositions. The optional ingredients are selected from, but not limited to, the group comprising sodium borohydride, BHT (2,6-di-tert-butyl-4methylphenol), citric acid, etc.

Further, optional ingredients such as brightening agents, perfumes, dyes, opacifiers, shrinkage controllers, spotting agents and the like, may be added to the final compositions. Other well-known optional components which may be present in the final compositions of the present invention a narrated in U.S. Pat. No. 4,103,047, Zaki et al., issued Jul. 25, 1978, for "Fabric Treatment Compositions," incorporated herein by reference. Such optional components include anti-creasing agents, finishing agents, fumigants, lubricants, fungicides, and sizing agents. The amounts of these components may vary greatly, but generally comprise from about 0.01 percent to about 10 percent, based on the weight of the final composition.

Dispensing Means

The fabric conditioning compositions are provided as an article of manufacture in combination with a dispensing means such as a flexible substrate. Any flexible substrate which effectively releases the fabric conditioning composition in an automatic clothes dryer can be used in the present invention. For example, useful flexible substrates are listed and described in detail in Zaki et al., U.S. Pat. No. 4,022,938, issued May 10, 1977, which is hereby incorporated by reference. The dispensing means may be designed for single or multiple uses. The fabric conditioning compositions may be alternatively employed by adding a predetermined amount directly to the dryer.

One such article of the present invention comprises a sponge or porous material releasably enclosing enough fabric conditioning composition to effectively impart fabric care benefits during several cycles of clothes. Such a substrate will have a weight ratio of fabric conditioning agent to dry substrate on a dry weight basis ranging from about 10:1 to about 0.25:1. This multi-use article can be made by filling, for example, a hollow sponge with about 20 grams of the fabric conditioning composition.

Other devices and articles suitable for dispensing the fabric conditioning composition into automatic dryers include those described in U.S. Pat. No. 4,103,047, Zaki et al., issued Jul. 25, 1978; U.S. Pat. No. 3,736,668, Dillarstone, issued Jun. 5, 1973; U.S. Pat. No. 3,701,202, Compa et. al., issued Oct. 31, 1972; U.S. Pat. No. 3,634,947, Furgal, issued Jan. 11, 1972; and U.S. Pat. No. 3,435,537, Rumsey, issued Apr. 1, 1969. All of these patents are incorporated herein by reference.

A highly preferred article herein comprises the fabric conditioning composition releasably affixed to a flexible substrate in a sheet configuration. Highly preferred paper, woven or nonwoven "absorbent" substrates useful herein are fully disclosed in Morton, U.S. Pat. No. 3,686,026, issued Aug. 22, 1972, incorporated herein by reference. It is known that most substances are able to absorb a liquid substance to some degree; however, the term "absorbent" as used herein, is intended to mean a substance with an absorbent capacity (i.e., a parameter representing a substrate's ability to take up and retain a liquid) from about 4 to about 12, preferably about 5 to about 7, times it weight of water.

Determination of absorbent capacity values is made by using the capacity testing procedures described in U.S. Federal Specifications UU-T-595b, or may be made by using the testing procedure with the following modifications:

1. tap water is used instead of distilled water.
2. the specimen is immersed for 30 second instead of 3 minutes;
3. draining time is 15 seconds instead of 1 minute, and
4. the specimen is immediately weighed on a torsion balance having a pan with tuned-up edges.

Absorbent capacity values are then calculated in accordance with the formula given in said Specification. Based on this test, on-ply, dense bleached paper (e.g., kraft or bond having a basis weight of about 32 pounds per 3,0000 square feet) has an absorbent capacity of about 3.5 to about 4, commercially available household one-ply toweling paper has a value of about 5 to about 6; and commercially available two-ply household toweling paper has a value of 7 to about 9.5.

Using a substrate with an absorbent capacity of less than 4 tends to cause too rapid release of the fabric conditioning composition from the substrate resulting in several disadvantages, one of which is uneven conditioning of the fabrics. Using a substrate with an absorbent capacity over about 12 is undesirable, inasmuch as too little of the fabric conditioning composition is released to condition the fabrics in optimal fashion during a normal drying cycle.

Such a substrate comprises a nonwoven cloth having an absorbent capacity of preferably from about 5 to about 7 and wherein the weight ratio of fabric conditioning composition to substrate on a dry weight basis ranges from bout 5:1 to about 1:1.

Nonwoven cloth substrate comprises polyester and/or cellulosic fibers having a length of from about {fraction (3/16)} inch to about 2 inches and a denier of from about 2.5 to about 5 and the substrate is adhesively bonded together with a binder resin. Typically nonwoven polyester spun/bond fibers are utilized in which randomly oriented polyester fibers are spun as a melt and are then flattened and heated to bind the fibers.

The flexible substrate preferably has openings sufficient in size and number to reduce restriction by said article of the flow of air through an automatic laundry dryer.

Article of Manufacture

The articles herein comprise acyloxyalkyl quaternary ammonium compounds and mixtures of glycerin/glyceryl esters in combination with any dispensing means suitable for releasing the fabric conditioning composition to the fabric load at temperatures encountered in automatic laundry dryers. Preferred articles herein are those wherein the fabric conditioning composition is releasably affixed to an absorbent substrate as an impregnate or as a coating. The impregnation or coating can be accomplished by any convenient manner, and many methods are known in the art. For example, the fabric conditioning composition, in liquid form, can be sprayed onto a substrate or can be added to a wood-pulp slurry from which the substrate is manufactured.

Impregnating, rather than coating, the substrate with the fabric conditioning composition is highly preferred for optimal conditioning with minimal fabric staining. The term "coating" connotes the adjoining of one substance to the external surface of another; "impregnating" is intended to mean the permeation of the entire substrate structure, internally as well as externally. One factor affecting a given substrate's absorbent capacity is its free space. Accordingly, when a fabric conditioning composition is applied to an absorbent substrate, it penetrates into the freespace; hence, the substrate is deemed impregnated. The free space in a substrate of low absorbency, such as a one-ply kraft or bond paper, is very limited; such a substrate, is therefore deemed "dense." Thus, while a small portion of the fabric conditioning composition penetrates into the limited freespace available in a dense substrate, a rather substantial balance of the fabric conditioner composition does not penetrate and remains on the surface of the substrate so that it is deemed a coating.

In one method of making the preferred conditioner-impregnated absorbent sheet substrate, a fabric conditioning composition containing acyloxyalkyl quaternary ammonium compound(s) and mixtures of glycerin/glyceryl esters, alone or with the optional additives, is applied to absorbent paper or nonwoven cloth by a method generally known as "padding". The fabric conditioning composition is preferably applied in liquid form to the substrate. Thus, the fabric conditioner composition, which is normally a solid or a semi-solid at room temperature should first be melted. Methods of melting the fabric conditioning compositions and/or for treating the fabric conditioning compositions are known and can easily be performed to provide a satisfactory conditioner-treated substrate.

In another preferred method, the fabric conditioning composition, in liquefied form, is placed in a pan or trough which can be heated to maintain the fabric conditioning composition in liquid form. The liquid fabric conditioning composition contains any of the desired optional additives. A roll of absorbent paper (or cloth) is then set up on an apparatus so that it can unroll freely. As the paper or cloth unrolls, it travels downwardly and, submersed, passes through the pan or trough containing the liquid fabric conditioning composition at a slow enough speed to allow sufficient impregnation. The absorbent paper or cloth then travels upwardly and through a pair of rollers which remove excess bath liquid and provide the absorbent paper or clothes with about 1 to about 12 grams of the fabric conditioning composition per 100 sq. inches to 150 sq. inches (645 to 968 sq. cm) of substrate sheet. The impregnated paper or cloth is then cooled to room temperature, after which it can be folded, cut or perforated at uniform lengths, and subsequently packaged and/or used.

The rollers used resemble "squeeze rolls" used by those in the paper and paper-making art; they can be made of hard rubber or steel. Preferably, the rollers are adjustable, so that the opening between their respective surfaces can be regulated to control the amount of the fabric conditioning composition liquid on the paper or cloth.

In applying the fabric conditioning compositions to the absorbent substrate, the amount of fabric conditioning composition impregnated into or coated onto the absorbent substrate is conveniently in the weight ratio range of from about 10:1 to 0.25:1 based on the ratio of total fabric conditioning composition to dry, untreated substrate ranges from about 5:1 to about 1:1, most preferably from about 3:1 to about 1:1.

Following application of the liquefied fabric conditioning composition, the articles are held at room temperature until the fabric conditioning composition solidifies. The resulting dry articles, prepared at the fabric conditioning composition:substrate ratios set forth above, remain flexible; the sheet articles are suitable for packaging in rolls. The sheet articles can optionally be slitted or punched to provide a non-blocking aspect (as directed previously) at any convenient time during the manufacturing process.

The most highly preferred articles herein are those where the fabric conditioning composition is releasably affixed to a woven or nonwoven cloth substrate of the type disclosed herein above having an absorbent capacity of from about 2 to about 15. A highly preferred substrate for such an article has an absorbent capacity of from about 5 to 7.

The most highly preferred articles herein are those wherein the flexible substrate is provided with openings sufficient in size and number to reduce restriction by said article of the flow of air through the automatic dryer. Articles wherein the openings comprise a plurality or rectilinear slits extending along one dimension of the substrate, especially those wherein the slits extend to within 1 inch from at least one edge of said dimension of the substrate, articles wherein the slits comprise a plurality of curvilinear slits in a continuous pattern of U-shaped or C-shaped slits, and articles wherein the openings comprise circular holes, are highly preferred herein.

It is most convenient to provide an article in the form of a nonblocking sheet substrate having the physical parameters noted herein above, said substrate having an area of from about 50 sq. in. to about 200 sq. in. (322 sq. cm. to 1290 sq. cm.), containing from about 1.5 grams to about 7.5 grams of the conditioning composition releasably impregnated in said substrate. The articles are provided with openings such as the holes or slits described herein above, said openings from about 0.5% to about 75%, preferably 5% to about 40%, of the area of the article, said openings being so disposed as to provide a nonblocking effect.

Usage

The method aspect of this invention for imparting the above described fabric conditioning composition to provide static control and softening benefits to fabrics in an automatic laundry dryer comprises: Commingling pieces of damp fabrics by tumbling said fabrics under heat in an automatic clothes dryer with an effective amount of the fabric conditioning composition, said composition being flowable at dryer operating temperature, and said composition comprising a mixture of about 20 percent to about 80 percent of an acyloxyalkyl quaternary ammonium compound and about 80 percent to about 20 percent of a mixture of glycerin and glyceryl esters.

The method herein is carried out in the following manner. Damp fabrics, usually containing from about 1 to about 1.5 times their weight in water, are placed in the drum of an automatic clothes dryer. In practice, such damp fabrics are commonly obtained by laundering, rinsing and spin-drying the fabrics in a standard washing machine. The fabric conditioning composition can simply be spread uniformly over all fabric surfaces, for example by sprinkling the composition onto the fabrics from a shaker device. Alternatively, the fabric composition can be sprayed or otherwise coated on a dryer drum itself. The dryer is then operated in standard fashion to dry the fabrics, usually at a temperature from about 50° C. to about 80° C., for a period from about 10 minutes to about 60 minutes, depending on the fabric load and type. On removal from the dryer, the dried fabrics have been treated for static control and softening benefits.

In preferred mode, the present process is carried out by fashioning an article comprising the substrate-like dispensing means of the type herein above described in releasable combination with a fabric conditioning composition. This article is simply added to a clothes dryer together with the damp fabrics to be treated. The heat and tumbling action of the revolving dryer drum evenly distributes the composition over all fabric surfaces, providing the fabric conditioning benefits and drying the fabrics.

All documents, e.g., patents and journal articles, cited above or below are hereby incorporated by reference in their entirety.

In the following examples, all amounts are stated in percent by weight of active material unless indicated otherwise. One skilled in the art will recognize that modifications may be made in the present invention without deviating from the spirit or scope of the invention. The invention is illustrated further by the following examples which are not to be construed as limiting the invention or scope of the specific procedures or compositions described herein.

EXAMPLE 1

Triethanolamine-Hard Coconut Oil Based Ester Quat Preparation and Properties A 5 L flask, equipped with a thermocouple, a nitrogen sparge line, a means for agitation and a distillation apparatus, is sequentially charged with about 1564 g of hard coconut oil and about 436 g of triethanolamine. The contents of the flask are heated to about 140° C. until homogeneous and about 0.40 g of sodium borohydride ($NaBH_4$) powder is optionally added to improve the color of the contents of the flask. (If $NaBH_4$ powder is added, the contents of the flask are heated at about 140° C. for about 30 minutes.) Next, about 2.0 g of calcium hydroxide ($Ca(OH)_2$) is added to the contents of the flask. The contents of the flask are at about 160° C. for 4 hours.

After heating at 160° C. for 4 hours, the contents of the flask are cooled to about 80≧C. and about 1.69 g of $NaBH_4$ (12 wt. % in 45% NaOH) solution is optionally added to the contents of the flask to improve color. (If the $NaBH_4$ solution is added, the contents of the flask are allowed to react for about 30 minutes at about 80° C.) Next, about 4.52 g sodium bisulfite (SBS, 38 wt. % in water) is also optionally added to improve color. (If the SBS is added, the contents of the flask are allowed to react for about 30 minutes at about 80° C.) Next, about 221 g of isopropyl alcohol (IPA) is added to the flask and the temperature of the contents of the flask is lowered to about 65° C. Once the 65° C. temperature is reached, about 275 g of dimethyl sulfate (DMS) is added to the flask dropwise over a 60 minute period. After the DMS addition is complete, the contents of the flask are allowed to react for an additional 60 minutes.

If further improvements in color art desirable 4.23 g of sodium chlorite ($NaClO_2$; 25 wt. % in water) and 4.52 g SBS are added to the contents of the flask and allowed to react for an additional 30 minutes.

The viscosity analysis of the sample is reported below in tabular form.

| Speed RPM | Temperature ° C. | Viscosity cPs |
|---|---|---|
| 50.0 | 28.2 | 2170.0 |
| 100.0 | 29.1 | 2140.0 |
| 100.0 | 36.0 | 1310.0 |
| 100.0 | 41.0 | 1104.0 |
| 25.0 | 47.0 | 572.0 |
| 50.0 | 47.0 | 456.0 |
| 100.0 | 47.0 | 439.5 |
| 50.0 | 53.0 | 367.0 |
| 150.0 | 53.0 | 350.0 |
| 50.0 | 60.0 | 267.0 |
| 100.0 | 60.0 | 266.0 |
| 150.0 | 60.0 | 265.0 |
| 100.0 | 67.0 | 187.0 |
| 150.0 | 67.0 | 186.0 |
| 200.0 | 67.0 | 186.0 |
| 150.0 | 74.0 | 134.7 |
| 200.0 | 74.0 | 134.3 |
| 250.0 | 74.0 | 134.0 |
| 150.0 | 82.1 | 95.3 |
| 200.0 | 82.1 | 95.3 |
| 250.0 | 82.2 | 95.2 |

EXAMPLE 2

Triethanolamine-Hard Coconut Oil (Hard Tallow Based Ester Quat Preparation and Properties A 5 L flask, equipped with a thermocouple, a nitrogen sparge line, a means for agitation and a distillation apparatus, is sequentially charged with about 1928 g of hard tallow, about 482 g of hard coconut oil and 585 g triethanolamine. The contents of the flask are heated to about 190° C. until homogeneous and about 0.60 g of sodium borohydride ($NaBH_4$) powder is optionally added to improve the color of the contents of the flask. (If $NaBH_4$ powder is added, the contents of the flask are heated at about 190° C. for about 30 minutes.) Next, about 3.0 g of calcium hydroxide ($Ca(OH)_2$) is added to the contents of the flask. The contents of the flask are then heated at about 190° C. for an additional 4 hours.

After heating at 190° C. for 4 hours, the contents of the flask are cooled to about 65° C. and about 470 g of dimethyl sulfate (DMS) is added to the flask dropwise over a 60 minute period. After the DMS addition is complete, the contents of the flask are allowed to react for an additional 60 minutes at about 65° C.

If improvements in color are desirable, 6.97 g of sodium chlorite ($NaClO_2$; 25 wt. % in water) is added to the contents of the flask allowed to react for an additional 15 minutes at about 70° C.

If preservatives are desired, 3.48 g of BHT powder and 3.48 g of citric acid are added to the contents of the flask.

The viscosity analysis of the sample is reported below in tabular form.

| Temperature ° C. | Viscosity cP |
|---|---|
| 51.9 | 780.0 |
| 51.9 | 582.0 |
| 51.9 | 535.0 |
| 52.7 | 615.0 |
| 52.7 | 518.0 |
| 52.7 | 494.0 |
| 54.2 | 490.0 |
| 54.2 | 462.0 |
| 54.2 | 449.0 |
| 55.4 | 486.0 |
| 55.4 | 459.0 |
| 55.4 | 444.5 |
| 56.9 | 472.0 |
| 56.9 | 447.0 |
| 56.9 | 432.5 |
| 59.9 | 440.0 |
| 59.9 | 417.0 |
| 59.9 | 404.5 |
| 62.1 | 399.0 |
| 62.1 | 386.0 |
| 65.5 | 364.0 |
| 65.5 | 352.0 |
| 71.0 | 305.5 |
| 71.0 | 302.7 |
| 76.6 | 250.0 |
| 76.6 | 248.5 |
| 82.1 | 201.3 |
| 82.1 | 200.8 |

EXAMPLE 3

Triethanolamine-Hard Coconut Oil/Hard Tallow Based Ester Quat Preparation and Properties A 5 L flask, equipped with a thermocouple, a nitrogen sparge line, a means for agitation and a distillation apparatus, is charged with about 1244 g of hard tallow, about 319 g of hard coconut oil and about 434 g triethanolamine. The contents of the flask are heated to about 160° C. until homogeneous and about 0.40 g of sodium borohydride ($NaBH_4$) powder is optionally added to improve the color of the contents of the flask. (If $NaBH_4$ powder is added, the contents of the flask are heated at about 160° C. for about 30 minutes.) Next, about 2.0 g of calcium hydroxide ($Ca(OH)_2$) is added to the contents of the flask. The contents of the flask are then heated at about 160° C. for an additional 4 hours.

After heating at 160° C. for 4 hours, the contents of the flask are cooled to about 80° C. and about 1.00 g of $NaBH_4$ (12 wt. % in 45% NaOH) solution is optionally added to the contents of the flask to improve color. (If the $NaBH_4$ solution is added, the contents of the flask are allowed to react for about 30 minutes at about 80° C.) Next, about 2.69 g sodium bisulfite (SBS, 38 wt. % in water) is also optionally added to improve color. (If the SBS is added, the contents of the flask are allowed to react for about 30 minutes at about 80° C.) The temperature of the flask is lowered to about 65° C. and about 184 g of sulfate (DMS) is added to the flask dropwise over a 60 minute period. After the DMS addition is complete, the contents of the flask are allowed to react for an additional 60 minutes.

If further improvements in color are desirable, 2.51 g of sodium chlorite ($NaClO_2$; 25 wt. % in water) and 2.69 g SBS are added to the contents of the flask and allowed to react for an additional 30 minutes.

EXAMPLE 4

Triethanolamine-Hard Tallow Based Ester Quat Preparation and Properties

A 5 L flask, equipped with a thermocouple, a nitrogen sparge line, a means for agitation and a distillation apparatus, is charged with about 2432 g of hard tallow and 568 g triethanolamine. The contents of the flask are heated to about 190° C. until homogeneous and about 0.60 g of sodium borohydride ($NaBH_4$) powder is optionally added to improve the color of the contents of the flask. (If $NaBH_4$ powder is added, the contents of the flask are heated at about 190° C. for about 30 minutes.) Next, about 3.0 g of calcium hydroxide ($Ca(OH)_2$) is added to the contents of the flask. The contents of the flask are heated at about 190° C. for an additional 4 hours.

After heating at 190° C. for 4 hours, the contents of the flask are cooled to about 65° C. and about 470 g of dimethyl sulfate (DMS) is added to the flask dropwise over a 60 minute period. After the DMS addition is complete, the contents of the flask are allowed to react for an additional 60 minutes at about 65° C.

If improvements in color are desirable, 6.97 g of sodium chlorite ($NaClO_2$; 25 wt. % in water) is added to the contents of the flask allowed to react for an additional 15 minutes at about 70° C. If preservatives are desired, 3.48 g of BHT powder and 3.48 g of citric acid are added.

EXAMPLE 5

Triethanolamine-Hard Tallow Based Ester Quat Preparation and Properties

A 5 L flask, equipped with a thermocouple, a nitrogen sparge line, a means for agitation and a distillation apparatus, is charged with about 2345 g of hard tallow and 651 g triethanolamine. The contents of the flask are heated to about 190° C. until homogeneous and about 0.60 g of sodium borohydride ($NaBH_4$) powder is optionally added to improve the color of the contents of the flask. (If $NaBH_4$ powder is added, the contents of the flask are heated at about 190° C. for about 30 minutes.) Next, about 3.0 g of calcium hydroxide ($Ca(OH)_2$) is added to the contents of the flask. The contents of the flask are then heated at about 190° C. for 4 hours.

After heating at 190° C. for 4 hours, the contents of the flask are cooled to about 65° C. and about 470 g of dimethyl sulfate (DMS) is added to the flask dropwise over a 60 minute period. After the DMS addition is complete, the contents of the flask are allowed to react for an additional 60 minutes at about 65° C.

If improvements in color are desirable, 6.97 g of sodium chlorite ($NaClO_2$; 25 wt. % in water) is added to the contents of the flask allowed to react for an additional 15 minutes at about 70° C. If preservatives are desired, 3.48 g of BHT powder and 3.48 g of citric acid are added.

EXAMPLE 6

Triethanolamine-Soft Tallow Based Ester Quat Preparation and Properties

A 5 L flask, equipped with a thermocouple, a nitrogen sparge line, a means for agitation and a distillation apparatus, is charged with about 2972 g of soft tallow and about 828 g of triethanolamine. The contents of the flask are heated to about 160° C. until homogeneous and about 0.76 g of sodium borohydride ($NaBH_4$) powder is optionally added to improve the color of the contents of the flask. (If $NaBH_4$ powder is added, the contents of the flask are heated at about 140° C. for about 30 minutes.) Next, about 3.8 g of calcium hydroxide ($Ca(OH)_2$) is added to the contents of the flask. The contents of the flask are then heated at about 160° C. for an additional 4 hours.

After heating at 160° C. for 4 hours, the contents of the flask are cooled to about 80° C. and about 3.18 g of $NaBH_4$ (12 wt. % in 45% NaOH) solution is optionally added to the contents of the flask to improve color. (If the $NaBH_4$ solution is added, the contents of the flask are allowed to react for about 30 minutes at about 80° C.) Next, about 8.51 g sodium bisulfite (SBS, 38 wt. % in water) is also optionally added to improve color. (If the SBS is added, the contents of the flask are allowed to react for about 30 minutes at about 80° C.) Next, about 418 g of isopropyl alcohol (IPA) is added to the flask and the temperature of the contents of the flask is lowered to about 65° C. Once the 65° C. temperature is reached, about 517 g of dimethyl sulfate (DMS) is added to the flask dropwise over a 60 minute period After the DMS addition is complete, the contents of the flask are allowed to react for an additional 60 minutes.

If further improvements in color are desirable. 7.95 g of sodium chlorite ($NaClO_2$; 25 wt. % in water) and 8.15 g SBS are added to the contents of the flask and allowed to react for an additional 30 minutes.

EXAMPLE 7

Comparison of Blended Triethanolamine-Hard Tallow/Hard Coconut Oil Ester Quat to Triethanolamine-Hard Tallow Ester Quat A 5 L flask, equipped with a thermocouple, a nitrogen sparge line, a means for agitation and a distillation apparatus, is charged with about 2001 g of hard tallow and about 467 g of triethanolamine. The contents of the flask are heated to about 140° C. until homogeneous and about 1.23 g of sodium borohydride ($NaBH_4$) powder is optionally added to improve the color of the contents of the flask. (If $NaBH_4$ powder is added, the contents of the flask are heated at about 140° C. for about 30 minutes.) After this period of time the reaction contents are heated to 190° C. for 7 hours. The reaction contents are then cooled to 79° C. and stored at 79° C. for 24 hours.

The % triethanolamine is determined to be 2.21% and the amine equivalent by potentiometric perchloric acid titration was found to be 1.271 meq/g. Based on this value and a material weight of 2349 grams, 362 grams (2.869 moles) of dimethyl sulfate is charged to the reaction flask dropwise over one hour period at about 53° C. During the course of DMS addition the temperature of the reaction contents increases to about 85° C. After the DMS addition is complete, the reaction contents are heated to 88° C. for one hour. The amount of free amine for the sample is determined to be 0.0492 meq/g and an additional 12 grams (0.092 moles) of DMS is charged to the reaction flask over a period of 1.5 hours at 88° C. After the addition of the second alloquat of DMS, the final free amine is 0.0163 meq/g.

The final step of the sample preparation consists of bleaching the reaction contents with 3.51 grams of sodium chlorite (25%) followed by the addition of BHT (2.8 grams) and citric acid (2.88 grams). This sample had a melt point of −63° C.

An ester quat blend of 80 wt. % Triethanolamine-Hard Tallow Based Ester Quat (prepared as per Example # 5) and 20 wt. % Triethanolamn-Hard Coconut Oil Based Ester Quat (prepared as per Example # 1) was prepared and compared to the Triethanolamine-Hard Tallow Ester Quat prepared above. The results of the comparision are shown below.

| | HARD TALLOW TRIETHANOL-AMINE ESTER QUAT | BLEND OF HARD TALLOW/HARD COCO TRIETHANOLAMINE ESTER QUATS |
|---|---|---|
| Melt Point (DSC), ° C. | 59.4 | 53.7 |
| Melt Point (visual), ° C. | 63 | 58 |
| Melt Point (visual: with 6.0% Fragrance Loading), ° C. | 57–58 | 53–55 |
| pH (10% in 1/1: IPA/$H_2O$) | 2.34 | 2.50 |
| Free Amine, meq/g | 0.0157 | 0.0374 |
| Amine Hydromethyl sulfate, meq/g | 0.1582 | 0.1456 |
| Cationic Actives, meq/g | 0.8576 | 0.8608 |

EXAMPLE 8

Triethanolamine-Hard Tallow/Hard Coconut Oil Ester Quat Preparation and Properties A 5 L flask, equipped with a thermocouple, a nitrogen sparge line, a means for agitation and a distillation apparatus, is charged with 1949.3 grams (2.291 moles) of hard tallow, 468.4 grams (0.662 moles) of hard coconut oil. 588.4 grams (3.949 moles) of triethanolamine, and 1.51 grams of sodium borohydride. The contents of the flask are heated to about 140° C. until homogeneous and about 1.23 g of sodium borohydride ($NaBH_4$) powder is optionally added to improve the color of the contents of the flask. (If $NaBH_4$ powder is added, the contents of the flask are heated at about 140° C. for about 30 minutes.) After this period of time the reaction contents are heated to 190° C. for 7 hours. The reaction contents are then cooled to 67° C. and stored at 67° C. for 24 hours.

The percent free triethanolamine is determined to be 2.57% and the amine equivalent by potentiometric perchloric acid titration was found to be 1.302 meq/g. Based on this value and a material weight of 2941 grams, 481 grams (3.816 moles) of dimethyl sulfate is charged to the reaction flask dropwise over one hour period at about 68° C. During the course of DMS addition the temperature of the reaction contents increases to about 88° C. After the DMS addition is complete, the reaction contents are heated to 88° C. for one hour. The amount of free amine for the sample is determined to be 0.0149 meq/g.

The final step of the sample preparation consists of bleaching the reaction contents with 6.9 grams of sodium chlorite (25%) followed by the addition of BHT (3.45 grams) and citric acid (6.91 grains). This sample had a melt point of −60° C. The phsyical properties of the sample are shown below.

| | 80/20 HARD TALLOW/HARD COCO TRIETHANOLAMINE ESTER QUAT |
|---|---|
| Melt Point (visual), ° C. | 55–60 |
| Melt Point (visual; with 6.0% Fragrance Loading), ° C. | 55 |
| pH (10% in 1/1: IPA/$H_2O$) | 1.83 |
| Free Amine, meq/g | 0.0166 |
| Amine Hydromethyl sulfate, meq/g | 0.2308 |
| Cationic Actives, meq/g | 0.964 |

Summary of Melting Point Data

The melting points of pure Triethanolamine-Hard Tallow Based Ester Quat (prepared as per Example #5), Triethanolamine-Hard Coconut Oil Based Ester Quat (prepared as per Example # 1) and mixtures thereof were determined as shown in the table below.

| Sample | % TEATG-HC | Melt Point ° F. | Melt Point ° C. |
|---|---|---|---|
| 100% TEATG-HC | 100 | 82.4 | 28.0 |
| 85% TEATG-HC/15% TEATG-HT | 85 | 95.0 | 35.0 |
| 75% TEATG-HC/25% TEATG-HT | 75 | 102.2 | 39.0 |
| 50% TEATG-HC/50% TEATG-HT | 50 | 114.8 | 46.0 |
| 25% TEATG-HC/75% TEATG-HT | 25 | 124.7 | 51.5 |
| 20% TEATG-HC/80% TEATG-HT | 20 | 126.5 | 52.5 |
| 15% TEATG-HC/85% TEATG-HT | 15 | 128.3 | 53.5 |
| 10% TEATG-HC/90% TEATG-HT | 10 | 130.1 | 54.5 |
| 100% TEATG-HT | 0 | 136.4 | 58.0 |

Static Reduction Results

Static reduction property testing data is reported below for several "leading brand" dryer sheet fabric softening compositions and the fabric conditioning composition previously described in Example 8 (Triethanolamine-Hard Tallow/Hard Coconut Oil Ester Quat). The testing was performed according to CSMA Test Method D-13; the tests were performed in duplicate. All sheets, towels, pillow cases and synthetic fabric "static swatches" were stripped as per CSMA Method D-13. The materials were machine-washed five times, two with detergent in the wash cycle followed by three without. Each wash bundle utilized for testing contained two sheets, two pillow cases, four hand towels, and two swatches each of acrylic, acetate, nylon, polyester, and rayon. Each static swatch was approximately 2'×2'. Each bundle was washed in a General Electric Washer, Model WWA-8500N, with a warm water wash and a cold water rinse. The temperature of the wash water was 102–105° F. The rinse water was 55–57° F. Toledo tap water was used throughout. A private label ultra detergent powder was used in each wash. After washing, the wash bundles were dried one at a time in a General Electric Dryer, Model DD#-9200N, at a normal cycle (about 40 minutes). The dryer was cleaned with alcohol after each use. A fabric softener sheet was added to the dryer with each of the test loads. A control load was dried without a softener sheet. After the dyer cycle, the synthetic static swatches were removed one at a time and hung on a wooden rack. The static charge was measured on each quadrant of the swatch with a Simco Electrostatic Locator Type SS-2x at a distance of two inches. During these measurements the relative humidity was measured with a digital hygrometer. For all the tests the humidity stayed between 35 and 40 percent RH. The readings for all the static swatches in the wash loads were totaled and used to compute the overall percent static reduction by the following formula:

$$\% \text{ Red}=100-(100)(x)/\text{Con}$$

What is claimed is:

1. An article of manufacture comprising:

(a) a fabric conditioning composition comprising a mixture of about 35 percent to about 65 percent of a saturated-acyloxyalkyl quaternary ammonium compound and about 65 percent to about 35 percent of a mixture of glycerin and glyceryl esters, wherein, said saturated acyloxyalkyl quaternary ammonium compound has the following general formula:

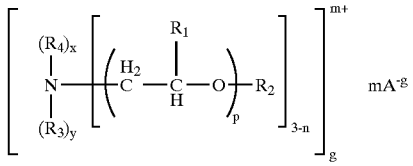

wherein each $R_1$ is independently a hydrogen atom or a branched or linear alkyl or alkenyl group from about 1–6 carbon atoms:

each $R_2$ is independently an alkylcarboxyl group derived from a stearic or a palmitic free fatty acid;

each $R^3$ is independently a branched or linear alkyl or alkenyl group from about 1–4 carbon atoms which is un-substituted or substituted with 1–3 hydroxyl groups, or is a group of the formula:

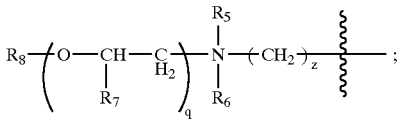

each $R_4$ is independently a branched or linear alkyl or alkenyl group from about 1 –4 carbon atoms, which is un-substituted or substituted with –3 hydroxyl groups;

each $R_5$ is a branched or linear alkyl or alkenyl group from about 8–23 carbon atoms;

each $R_6$ is a branched or linear alkyl or alkenyl group from about 1–4 carbon atoms which is un-substituted or substituted with 1–3 hydroxyl groups;

each $R_7$ is independently a hydrogen atom or a branched or linear alkyl or alkenyl group from about 1–6 carbon atoms;

each $R_8$ is a hydrogen atom or an alkylcarbonyl group containing from about 11 carbon atoms to about 23 carbon atoms;

q=1–100;

z=2 or 3;

p=1–100;

n=0, 1, or 2;

x and y are independently 0, 1, or 2 with (x+y)+(3–n)=4;

m=1 or 2;

g=1, 2 or 3; and

A is a monovalent anionic residue of an alkylating agent, or a monovalent or polyvalent anionic residue of a Bronsted acid; and wherein, said glyceryl esters are selected from the group consisting of monoglycerides, diglycerides and triglycerides;

(b) a dispensing means which provides for release of an effective amount of the fabric conditioning composition to fabric in an automatic clothes dryer, wherein the fabric conditioning composition is a solid or semi-solid at room temperature and has a melting point of about 30° C. to about 65° C.

2. An article according to claim 1, wherein $R_2$ is derived from a mixture of hydrogenated tallow and hydrogenated coconut oil.

3. An article according to claim 2, wherein the ratio of hydrogenated tallow to hydrogenated coconut oil is from about 1:9 to about 8.5:1.5.

4. An article according to claim 1, wherein $R_2$ is derived from hydrogenated tallow.

5. An article according to claim 1, wherein the alkylating agent is a member selected from a groups consisting of dimethyl sulfate, diethyl sulfate, dimethyl carbonate, trimethyl phosphate, methyl chloride, methyl bromide, methyl iodide, benzyl chloride and benzyl bromide.

6. An article according to claim 1, wherein the dispensing means comprises a flexible substrate in the form of a sheet having the fabric conditioning composition releasably affixed thereto to provide a weight ratio of fabric conditioning composition to flexible substrate of about 10:1 to about 0.1:1.

7. An article according to claim 1, wherein the dispensing means comprises a sponge material releasably enclosing the fabric conditioning composition wherein the weight ratio of fabric conditioning composition to sponge material of about 10:1 to about 0.1:1.

8. A method for imparting softening and static reduction effects to fabric in an automatic laundry dryer comprising commingling articles of damp fabric by tumbling the damp fabric under heat in an automatic clothes dryer with an effective amount of a fabric conditioning composition, the fabric conditioning composition being flowable at dryer operating temperature, the fabric conditioning composition comprising a mixture of about 35 percent to about 65 percent of a saturated acyloxyalkyl quaternary ammonium compound and about 65 percent to 35 percent of a mixture of glycerin and glyceryl esters, wherein, the saturated acyloxyalkyl quaternary ammonium compound has the following general formula:

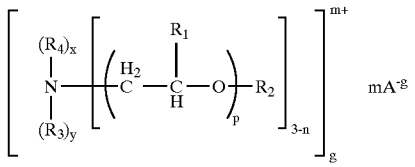

wherein, each $R_1$ is independently a hydrogen atom or a branched or linear alkyl or alkenyl group from about 1–6 carbon atoms;

each $R_2$ is independently an alkylcarboxyl group derived from a stearic or a palmitic free fatty acid;

each $R_3$ is independently a branched or linear alkyl or alkenyl group from about 1–4 carbon atoms which is un-substituted or substituted with 1–3 hydroxyl groups, or is a group of the formula:

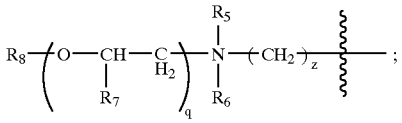

each $R_4$ is independently a branched or linear alkyl or alkenyl group from about 1–4 carbon atoms, which is un-substituted or substituted with 1–3 hydroxyl groups;

each. $R_5$ is a branched or linear alkyl or alkenyl group from about 8–23 carbon atoms;

each $R_6$ is a branched or linear alkyl or alkenyl group from about 1–4 carbon atoms which is un-substituted or substituted with 1–3 hydroxyl groups;

each $R_7$ is independently a hydrogen atom or a branched or Linear alkyl or alkenyl group from about 1–6 carbon atoms;

each $R_8$ is a hydrogen atom or an alkylcarbonyl group containing from about 11 carbon atoms to about 23 carbon atoms;

g=1–100;

z=2 or 3;

p=1–100;

n=0, 1, or 2;

x and y are independently 0, 1, or 2 with (x+y)+(3–n)=4;

m=1 or2;

g=1, 2 or 3; and

A is a monovalent anionic residue of an alkylating agent, or a monovalent or polyvalent anionic residue of a Bronsted acid; and wherein, said glyceryl esters are selected from the group consisting of monoglycerides, diglycerides and triglycerides.

9. A method according to claim 8, wherein $R_2$ is derived from a mixture of hydrogenated tallow and hydrogenated coconut oil.

10. A method according to claim 9, wherein the ratio of hydrogenated tallow to hydrogenated coconut oil is from about 1:9 to about 8.5:1.5.

11. A method according to claim 10, wherein $R_2$ is derived from hydrogenated tallow.

* * * * *